US005435385A

United States Patent [19]

Wilson

[11] Patent Number: 5,435,385

[45] Date of Patent: Jul. 25, 1995

[54] INTEGRATED WELLHEAD TUBING STRING

[75] Inventor: James A. Wilson, Dallas, Tex.

[73] Assignee: Double-E, Inc., Dallas, Tex.

[21] Appl. No.: 145,340

[22] Filed: Oct. 29, 1993

[51] Int. Cl.[6] ..... E21B 19/08

[52] U.S. Cl. ..... 166/84; 166/88

[58] Field of Search ..... 166/75.1, 84, 88, 69, 166/77

[56] References Cited

U.S. PATENT DOCUMENTS

| | | | |
|---|---|---|---|
| 2,179,814 | 11/1939 | Conaghan | 166/75.1 X |
| 3,399,901 | 5/1965 | Crow et al. . | |
| 3,416,767 | 12/1968 | Blagg . | |
| 3,817,094 | 6/1974 | Montgomery et al. . | |
| 3,980,137 | 9/1976 | Gray | 166/75.1 X |
| 4,289,294 | 9/1981 | McLean | 166/84 X |
| 4,291,768 | 9/1981 | Diehl | 166/83 X |
| 4,574,881 | 3/1986 | Bednarz | 166/75.1 |
| 4,580,628 | 4/1986 | Schaeper | 166/85 |
| 4,799,552 | 1/1989 | Acree | 166/75.1 X |
| 4,844,406 | 7/1989 | Wilson . | |
| 4,860,826 | 8/1989 | Land | 166/84 X |
| 4,907,650 | 3/1990 | Heinonen | 166/84 X |
| 5,067,563 | 11/1991 | Rode | 166/84 |

OTHER PUBLICATIONS

Woods FIG. G High Temperature Stuffing Box (informational sales brochure) Larkin Products, Inc.

Caption of Picture: Woods FIG. G Hi-Temp Stuffing Box (informational sales brochure) Woods Energy Products, Inc.

*Primary Examiner*—Ramon S. Britts
*Assistant Examiner*—Frank S. Tsay
*Attorney, Agent, or Firm*—L. Dan Tucker

[57] ABSTRACT

In one form of the invention, an integrated wellhead tubing string (100) having a reduced overall height is disclosed, comprising an integrated casing (104) having a first vertical bore (110) therethrough having a first inside diameter, a second vertical bore partially therethrough and having a second inside diameter, the second inside diameter greater than the first inside diameter, a first horizontal bore (108) therethrough in communication with the first vertical bore and a second horizontal bore (132) partially therethrough and in communication with the first vertical bore and positioned above and orthogonal to the first horizontal bore, a blowout preventer (106) comprising horizontally opposed, reciprocable rams disposed within the first horizontal bore, a production tee (128) formed by a threaded coupling (130) disposed on an outer surface of the integrated casing, the threaded coupling being in communication with the second horizontal bore, a stuffing box (134) disposed within the second vertical bore and a stuffing box cap (140) having an outside diameter substantially equal to the second inside diameter, the stuffing box cap disposed so as to extend partially into the second vertical bore wherein the integrated casing is continuous such that no seals exist between the blowout preventer, the production tee and the stuffing box. Other systems, devices and methods are disclosed.

12 Claims, 3 Drawing Sheets

INTEGRATED WELLHEAD TUBING STRING

TECHNICAL FIELD OF THE INVENTION

The present invention relates generally to the production of oil wells by means of beam pumping units, and more particularly to production tools for pumping wells.

BACKGROUND OF THE INVENTION

Beam pumping units are widely used in the petroleum industry in order to recover fluids (such as oil) from wells extending into subterranean formations. When the natural pressure of the subterranean oil field is not high enough to force the oil to the surface through the well, a downhole pump must be lowered into the well in order to pump the oil to the surface. Beam pumping units are employed to reciprocate a sucker rod string which extends into the well to actuate the downhole pump. Alternatively, the downhole pump may be actuated by a progressive cavity (or Archimedes' screw) pump which employs rotary rather than reciprocating action.

Referring to FIG. 1, there is illustrated a prior art beam pumping unit, indicated generally at 10. A wellhead 12 of a well which extends from the earth's surface 14 into a subterranean oil producing formation (not shown) comprises the upper portions of a casing string 16 and tubing string 18. The tubing string 18 extends from the wellhead to a suitable depth within the well, e.g. adjacent the subterranean formation. Oil from the well is produced through the tubing string 18 by means of a downhole pump (not shown) to the surface where it passes into a flowline 20.

The downhole pump is actuated by reciprocal movement of a sucker rod string 22. Sucker rod string 22 comprises a polished rod section **22*a* which extends through a stuffing box (see FIG. 2) of the tubing string 18, and a section 22*b* formed of a flexible cable. The cable section 22*b* is connected to a walking beam 24 by means of a "horsehead" 26. Walking beam 24 is pivotally mounted on a sampson post 28 by a pin connection 30. The walking beam 24 is reciprocated by a prime mover 32 such as an electric motor. The prime mover 32 drives the walking beam 24 through a drive system which includes a belt drive 34, crank 36, crank arm 38, and a pitman 40 which is pivotally connected between the crank arm 38 and walking beam 24 by means of pin connections 42 and 44. The outer end of crank arm 38 is provided with a counterweight 46 which balances a portion of the load on the sucker rod string 22*a* in order to provide for a fairly consistent load on the prime mover 32**. It will be recognized by those skilled in the art that the well structure and pumping equipment thus far described are conventional and merely exemplary, and that other suitable pumping units may be utilized in carrying out the present invention.

Referring now to FIG. 2, there is illustrated a prior art wellhead tubing string 18. Threaded connector 50 forms the lower portion of a blowout preventer 52 and is threaded to the end of the tubing string protruding from the wellhead. Blowout preventer 52 contains horizontally opposed sliding rams 54 (only one of which is visible in FIG. 2) which may be moved to sealing engagement with polished rod **22*a* for the purpose of confining pressure during emergencies or when it is necessary to shut the well in for servicing of the well. Rams 54 may be moved by hydraulic pressure applied at hydraulic valves 56** or by manual screw cranks (not shown) as is commonly known in the art.

A production tee 58 is connected to blowout preventer 52 by means of threaded connection 60. Production tee 58 includes a threaded connector 62 for connection to a flowline 20 (not shown). When oil is pumped to the surface by means of the downhole pump, it flows through blowout preventer 52 (when the rams 54 are in the open position), into production tee 58 and out of threaded connector 62 into the flowline 20.

A stuffing box 64 is connected to production tee 58 by means of threaded connection 66. Stuffing box 64 contains packing material 68 placed in engagement with polished rod **22*a* in order to form a seal therearound, even as the polished rod 22*a* reciprocates up and down while working the downhole pump. A cap 71 seals off the top of stuffing box 64 by means of threaded connection 72. Because of the seal provided around polished rod 22*a* by the packing material 68, no oil may flow above the stuffing box 64. All of the oil pumped to the surface is therefore forced out of production tee 58 and into flowline 20** where it may be collected for storage or transportation, such as by pipeline or truck.

Finally, a polished rod lubricator 70 is placed in frictional engagement with the polished rod **22*a* at a location immediately above the stuffing box 64. Lubricator 70 rests on top of stuffing box 64 by its own weight. Lubricator 70 contains two reservoirs 74 for holding a quantity of oil. The oil in reservoirs 74 is applied to the polished rod 22*a* for lubrication thereof by means of oil pads 76 and oil wicks 78. A dust seal 80 is provided for wiping dust and grit off of the polished rod 22*a*** during its downstroke.

The prior art wellhead tubing string arrangement described hereinabove has several drawbacks. First, several feet of height are added to the tubing string above the surface of the wellhead in order to accommodate all of the devices incorporated into the wellhead tubing string. This can be a significant problem in many applications, especially when there is limited available working height above the wellhead due to an overhead obstruction, such as an overhead railroad track used to service the pumps. Additionally, the many threaded connections between the various individual components require seals that are prone to leakage of oil, which has serious environmental consequences and is being increasingly policed by regulatory authorities. Accordingly, a wellhead tubing string which overcomes any or all of these problems is highly desirable. The present invention is directed toward meeting these needs.

SUMMARY OF THE INVENTION

It is therefore the object of the present invention to provide a wellhead tubing string which has a minimum overall height and which contains a minimum number of threaded connections.

To overcome the problems inherent in the prior art tubing strings, the present invention incorporates a novel integrated housing structure for both the blowout preventer and the production tee, and stuffing box. Such a design greatly decreases the overall height of the assembled wellhead tubing string and also provides for a minimum number of seals between components, thereby minimizing leakage.

In one form of the invention, an integrated wellhead tubing string having a reduced overall height is disclosed, comprising an integrated casing, a blowout preventer formed within the integrated casing, a production tee formed as part of the integrated casing and disposed adjacent the blowout preventer wherein no seal is required between the blowout preventer and the production tee.

In another form of the invention, an integrated wellhead tubing string having a reduced overall height is disclosed, comprising an integrated casing having a first vertical bore therethrough having a first inside diameter, a second vertical bore partially therethrough and having a second inside diameter, the second inside diameter greater than the first inside diameter, a first horizontal bore therethrough in communication with the first vertical bore and a second horizontal bore partially therethrough and in communication with the first vertical bore and positioned above and orthogonal to the first horizontal bore, a blowout preventer comprising horizontally opposed, reciprocable rams disposed within the first horizontal bore, a production tee formed by a threaded coupling disposed on an outer surface of the integrated casing, the threaded coupling being in communication with the second horizontal bore, a stuffing box disposed within the second vertical bore and a stuffing box cap having an outside diameter substantially equal to the second inside diameter, the stuffing box cap disposed so as to extend partially into the second vertical bore wherein the integrated casing is continuous such that no seals exist between the blowout preventer, the production tee and the stuffing box.

In another form of the invention, an integrated wellhead tubing string having a reduced overall height is disclosed, comprising an integrated casing having a first vertical bore therethrough having a first inside diameter, a second vertical bore partially therethrough and having a second inside diameter, the second inside diameter greater than the first inside diameter, a first horizontal bore therethrough in communication with the first vertical bore, a second horizontal bore partially therethrough and in communication with the first vertical bore and positioned above and orthogonal to the first horizontal bore and a third horizontal bore therethrough in communication with the second vertical bore and positioned above and orthogonal to the second horizontal bore, a blowout preventer comprising horizontally opposed, reciprocable rams disposed within the first horizontal bore, a production tee formed by a threaded coupling disposed on an outer surface of the integrated casing, the threaded coupling being in communication with the second horizontal bore, a stuffing box comprising horizontally opposed, reciprocable rams disposed within the third horizontal bore wherein the integrated casing is continuous such that no seals exist between the blowout preventer, the production tee and the stuffing box.

BRIEF DESCRIPTION OF THE DRAWINGS

The novel features believed to be characteristic of the invention are set forth in the appended claims. For a more complete understanding of the present invention, and for further details and advantages thereof, reference is now made to the following Detailed Description taken in conjunction with the accompanying drawings, in which:

It is to be expressly understood, however, that the drawings are for purposes of illustration only and are not intended as a definition of the limits of the invention. Such definition is made only by the appended claims.

DETAILED DESCRIPTION OF THE DRAWINGS

Figure 3:
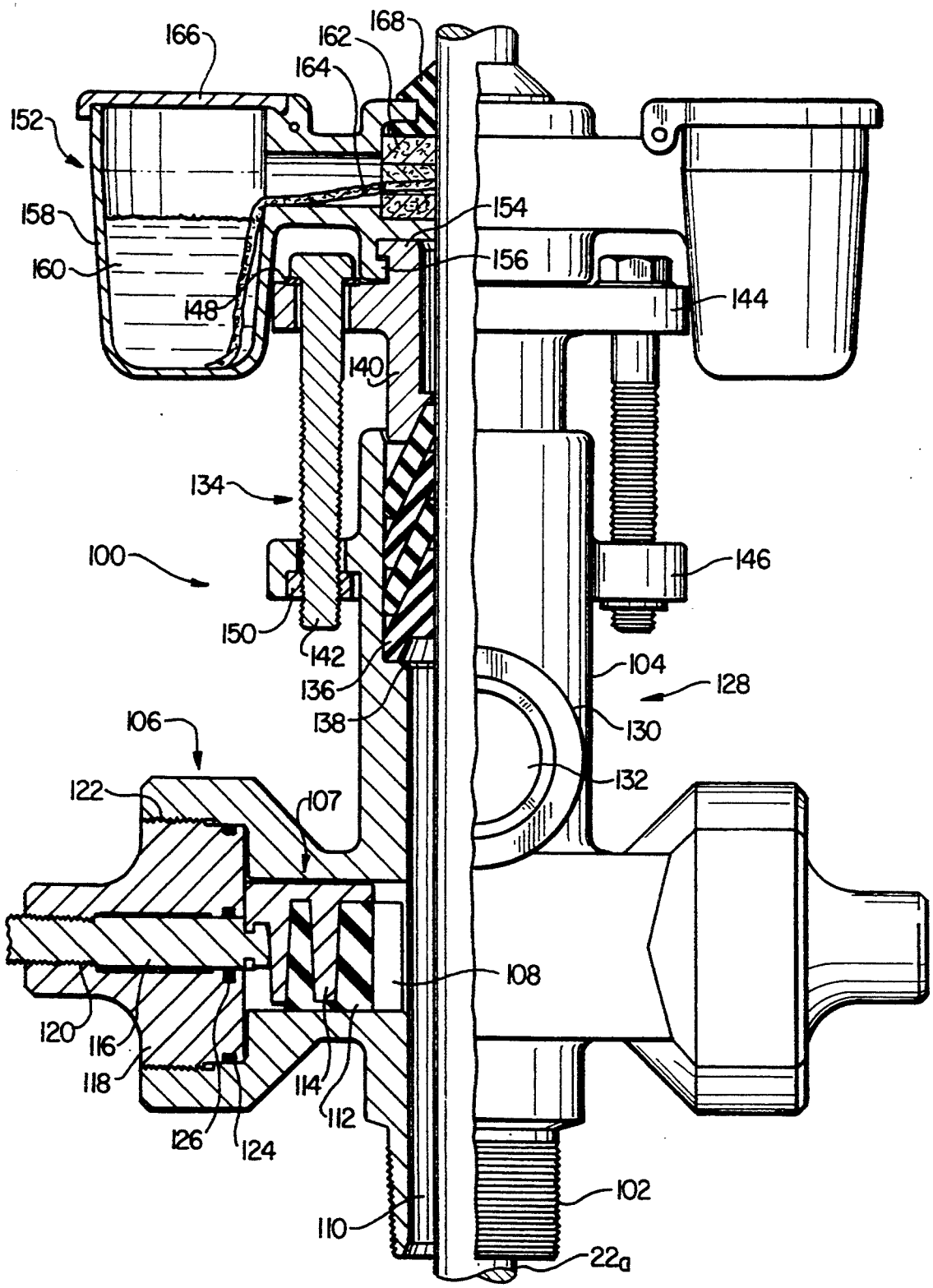
FIG. 3 is a partial cross-sectional view of a first embodiment of the present invention.

The present invention relates to a novel wellhead tubing string for pumping wells which reduces the overall height of the well above the wellhead and also limits the number of seals required. Referring to FIG. 3, there is illustrated a first embodiment of the present invention, indicated generally at 100. Wellhead tubing string 100 attaches to the end of the tubing string protruding from the wellhead by means of threaded connection 102. Threaded connection 102 forms the lower end of an integrated casing 104 which is a casting from ductile iron or steel and is preferably formed as a casting from 60-40-18 ductile iron. Integrated casing 104 provides a single exterior housing for a blowout preventer, a production tee and a stuffing box.

A blowout preventer 106 comprises two horizontally opposing rams 107 disposed in sliding engagement with a horizontal bore 108 which intersects a vertical bore 110 extending the length of integrated casing 104. Only one of the rams 107 is visible in the partial cross-sectional view of FIG. 3. Rams 107 comprise a rubber ram seal 112 and a ram plate 114. The seal 112 has a flat inside vertical seal surface. Rams 107 may be moved within the horizontal bore 108 by means of a screw shaft 116 engaged with ram plate 114 and threaded to a closure plug 118 by means of threads 120. Screw shaft 116 is rotated by means of an attached handle (not shown). Closure plug 118 is coupled to integrated housing 104 by means of threaded connection 122. O-ring seals 124 and 126 seal, respectively, the closure plug 118 to the integrated housing 104 and the screw shaft 116 to the closure plug 118.

The thickness and width of ram seals 112 between ram plate 114 and the vertical bore 110 are sufficient that when the opposing rams 107 are brought together within the bore 110, the inside faces of the confronting ram seals 112 will compress sufficiently to fully seal off the bore 110, whether the polished rod **22*a*, wireline, or the like is present or not in the bore 110. In other words, the extension of the inside portion of the ram seals 112 from the ram plates 114 must be sufficient that if the rams 107 are brought together around a polished rod, the ram seals 112 will fully close off the bore 110 around the polished rod 22*a*, and when the rams 107 are brought together with nothing present in the bore 110, the ram seals 112 will also compress sufficiently to fully seal off the bore 110**.

The above description of the internal mechanics of the blowout preventer 106 are given by way of description only. The present invention is not limited to any particular blowout preventer design. For a more detailed description of the blowout preventer 106, reference is made to U.S. Pat. No. 4,844,406, issued to the present inventor and assigned to the present assignee in this application, and hereby incorporated herein by reference in its entirety.

Immediately above the blowout preventer 106, and included in the same integrated casing 104, is a production tee 128. Production tee 128 includes a threaded connector 130 (also formed as part of the integrated casing 104) for connection to a flowline (not shown). Threaded connector 130 forms the distal end of a production bore 132 which intersects vertical bore 110 and is formed substantially orthogonal to horizontal bore 108. When oil is pumped to the surface by means of a downhole pump, it flows through blowout preventer 106 (when the rams 107 are in the open position), into production tee 128 and out of threaded connector 130 into the flowline.

The portion of integrated casing 104 that extends above threaded connection 130 forms a stuffing box 134. Vertical bore 110 is widened in the stuffing box 134 in order to provide a mounting surface for a plurality a packing material elements 136 which are placed in sliding engagement with polished rod 22a in order to form a seal therearound, even as polished rod 22a reciprocates up and down while working the downhole pump. On the downstroke of polished rod 22a, packing material 136 is held in place by its abutment with shelf 138 formed by the increased diameter of the vertical bore 110 within the stuffing box portion of integrated casing 104. On the upstroke of polished rod 22a, packing material 136 is held in place by abutment against a stuffing box cap 140. Stuffing box cap 140 has an outside diameter small enough to fit within the enlarged vertical bore 110 of the stuffing box 134, so that the lower surface of the stuffing box cap 140 abuts against the packing material 136. Stuffing box cap 140 is held in place by a plurality of bolts 142 which couple a flange 144 on the stuffing box cap 140 to a flange 146 on the integrated casing 104. A washer 148 is provided between the head of each bolt 142 and the flange 144. The flange 146 has recessed portions for receiving nuts 150 which hold the bolts 142 securely in place when tightened.

The remainder of the assembly 100 comprises a polished rod lubricator 152 placed in frictional engagement with the polished rod 22a above the stuffing box cap 140. Lubricator 152 rests on top of stuffing box cap 140 by its own weight and is prevented from moving upward during the upstroke of polished rod 22a by the engagement of flanges 154 and 156. Alternatively, the lubricator 152 may be held down by means of a chain (not shown) coupling the lubricator 152 to the stuffing box cap 140. Lubricator 152 contains two reservoirs 158 for holding a quantity of oil 160. The oil 160 is applied to the polished rod 22a for lubrication thereof by means of oil pads 162 and oil wicks 164. A hinged lid 166 covers the reservoir 158 and permits convenient replacement of the oil 160. A dust seal 168 is provided for wiping dust and grit off of the polished rod 22a during its downstroke.

Figure 2:
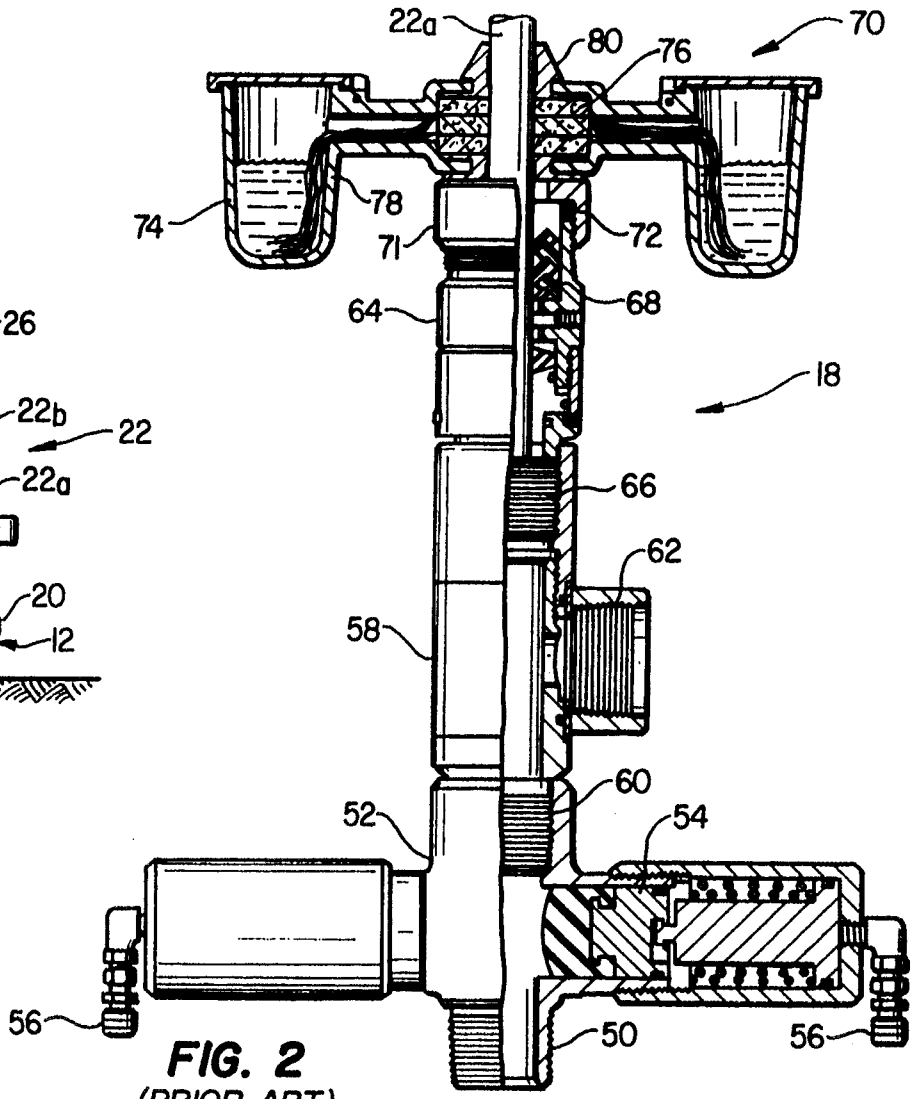
FIG. 2 (PRIOR ART)
FIG. 2 is a partial cross-sectional view of a prior art wellhead tubing string.
Figure 1:
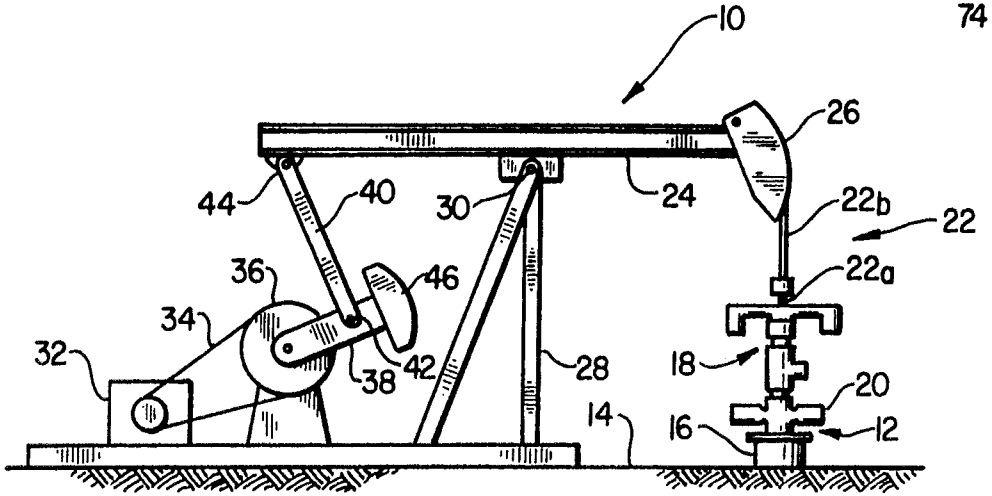
FIG. 1 (PRIOR ART)
FIG. 1 is an elevation view of a prior art walking beam oil pump.

It will be appreciated by those skilled in the art that the integrated casing design of the wellhead tubing string 100 provides significant advantages over the prior art devices. As shown in FIG. 3, there is virtually no wasted vertical distance between the horizontal bore 108 of the blowout preventer 106 and the production bore 132 of the production tee 128. This is in comparison to the significant vertical distance required to accommodate the threaded connection 60 in the prior art device 18 of FIG. 2. Additionally, there is no possibility of leakage between the blowout preventer 106 and the production tee 128 of the present invention because there is no seal formed therebetween. Similarly, there is virtually no wasted vertical distance between the production bore 132 of the production tee 128 and the bottom of the stuffing box 134 packing material 136. This is in comparison to the significant vertical distance required to accommodate the threaded connection 66 in the prior art device 18 of FIG. 2. Additionally, there is no possibility of leakage between the production tee 128 and the stuffing box 134 of the present invention because there is no seal formed therebetween. Another advantage over the prior art device is provided by the fact that access to the packing material 136 within the stuffing box 134 may be had by the removal of several bolts rather than the unthreading of the cap 71 of the prior art device, which entails the removal of various seals and split rings. A further advantage of the present invention is that a full open vertical bore is provided for the entire length of the integrated casing 104, so that, in case of an emergency, the whole string, including the downhole pump, may be pulled while the blowout preventer 106 is in place.

Figure 4:
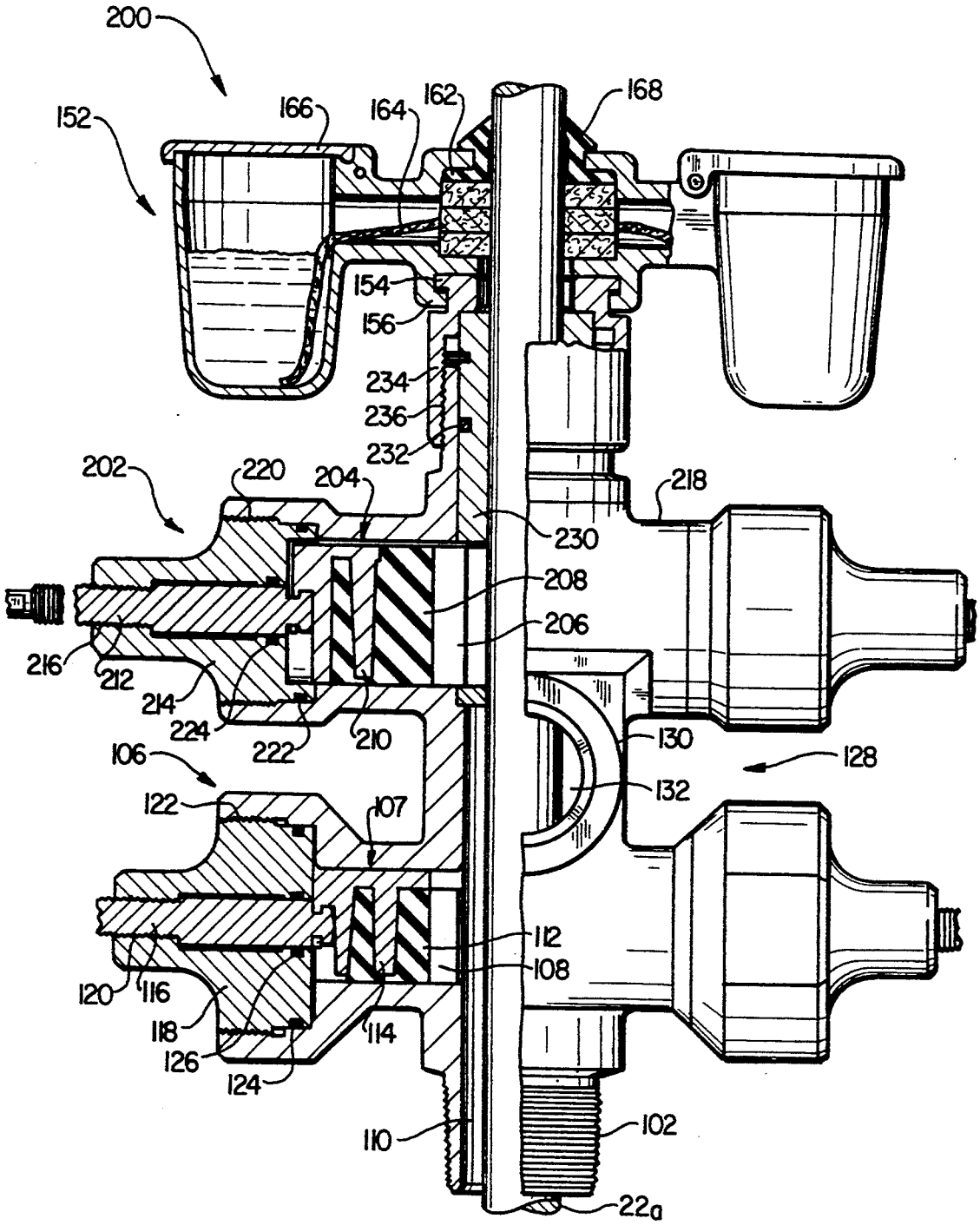
FIG. 4 is a partial cross-sectional view of a second embodiment of the present invention.

A second embodiment of the present invention is illustrated in FIG. 4 and indicated generally at 200. The blowout preventer 106, production tee 128 and lubricator 152 are all essentially the same as described with respect to the first embodiment of the present invention illustrated in FIG. 3. Like reference designators have been used to indicate like components. The device 200 incorporates an alternative design for the stuffing box 202. Stuffing box 202 comprises two horizontally opposing rams 204 disposed in sliding engagement with a horizontal bore 206 which intersects the vertical bore 110 extending the length of integrated casing 104. Only one of the rams 204 is visible in the partial cross-sectional view of FIG. 4. Rams 204 comprise a rubber ram seal 208 and a ram plate 210. The seal 208 has a flat inside vertical seal surface. Rams 204 may be moved within the horizontal bore 206 by means of a screw shaft 212 engaged with ram plate 210 and threaded to a closure plug 214 by means of threads 216. Screw shaft 212 is rotated by means of an attached handle (not shown). Closure plug 214 is coupled to integrated housing 218 by means of threaded connection 220. O-ring seals 222 and 224 seal, respectively, the closure plug 214 to the integrated housing 218 and the screw shaft 212 to the closure plug 214.

The thickness and width of ram seals 208 between ram plate 210 and the vertical bore 110 are sufficient that when the opposing rams 204 are brought together within the bore 110, the inside faces of the confronting ram seals 208 will compress sufficiently to fully seal around the polished rod 22a in order to form a seal therearound for preventing the escape of oil above the stuffing box 202 while the polished rod 22a is reciprocating within the vertical bore 110. Alignment of the polished rod 22a within the vertical bore 110 passing through the center of stuffing box 202 is maintained by brass positioning collar 230. Collar 230 is sealed to the integrated housing 218 by means of O-ring seal 232. Flange 154 is provided by threaded cover 234 which attaches to integrated housing 218 by means of threaded connection 236.

An advantage of the second embodiment design is that the stuffing box 202 rams 204 may be serviced without removing the lubricator 152. Rams 204 are accessed by removal of plugs 214. Additionally, the second embodiment device 200 maintains all of the advantages of the first embodiment device 100, illustrated in FIG. 3.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the appended claims.

I claim:

1. An integrated wellhead structure having a reduced overall height, comprising:
   a single exterior housing;
   a blowout preventer formed within said housing; and
   a production tee formed as part of said housing and disposed adjacent said blowout preventer.

2. The integrated wellhead structure of claim 1, further comprising:
   a stuffing box formed within said housing and disposed adjacent said production tee wherein no seal is required between said stuffing box and said production tee.

3. The integrated wellhead structure of claim 1 wherein said blowout preventer comprises two horizontally opposed rams reciprocable within a horizontal bore within said housing.

4. The integrated wellhead structure of claim 2 wherein said stuffing box comprises two horizontally opposed rams reciprocable within a horizontal bore within said housing.

5. The integrated wellhead structure of claim 1 wherein said housing includes a vertical bore therethrough and said production tee includes a horizontal bore through one side of said housing, said horizontal bore intersecting said vertical bore.

6. An integrated wellhead structure having a reduced overall height, comprising:
   a single exterior housing having
      a first vertical bore partially therethrough having a first inside diameter;
      a second vertical bore partially therethrough in communication with said first vertical bore and having a second inside diameter, said second inside diameter greater than said first inside diameter;
      a first horizontal bore therethrough in communication with said first vertical bore; and
      a second horizontal bore partially therethrough perpendicular to and in communication with said first vertical bore and positioned above said first horizontal bore;
      a blowout preventer comprising horizontally opposed, reciprocable rams disposed within said first horizontal bore;
      a production tee formed by a threaded coupling disposed on an outer surface of said housing, said threaded coupling being in communication with said second horizontal bore;
      a stuffing box disposed within and aligned with said second vertical bore; and
      a stuffing box cap having an outside diameter substantially equal to said second inside diameter, said stuffing box cap disposed so as to extend partially into said second vertical bore.

7. The integrated wellhead structure of claim 6 wherein said stuffing box includes a plurality of substantially conical resilient members disposed between an interface of said first and second vertical bores and said stuffing box cap.

8. The integrated wellhead structure of claim 6, further comprising:
   a rod lubricator means and engagement means operable to engage of said lubricator to the upper portion of said housing.

9. An integrated wellhead structure having a reduced overall height, comprising:
   a single exterior housing having
      a first vertical bore partially therethrough having a first inside diameter;
      a second vertical bore partially therethrough in communication with said first vertical bore and having a second inside diameter, said second inside diameter greater than said first inside diameter;
      a first horizontal bore therethrough in communication with said first vertical bore;
      a second horizontal bore partially therethrough perpendicular to and in communication with said first vertical bore and positioned above said first horizontal bore; and
      a third horizontal bore therethrough perpendicular to and in communication with said second vertical bore and positioned above said second horizontal bore;
      a blowout preventer comprising horizontally opposed, reciprocable rams disposed within said first horizontal bore;
      a production tee formed by a threaded coupling disposed on an outer surface of said housing, said threaded coupling being in communication with said second horizontal bore; and
      a stuffing box comprising horizontally opposed, reciprocable rams disposed within said third horizontal bore.

10. The integrated wellhead structure of claim 10, further comprising:
   positioning collar means disposed within said second vertical bore for aligning a sucker rod string reciprocating within said second vertical bore with said stuffing box rams.

11. The integrated wellhead structure of claim 10 wherein said positioning collar includes seal means for sealing engagement between said positioning collar and said second vertical bore to prevent the flow of liquids between said positioning collar and said second vertical bore.

12. The integrated wellhead structure of claim 9, further comprising:
   a lubricator means and engagement means operable to engage said lubricator to the upper portion of said housing.

* * * * *